United States Patent [19]

Gill

[11] Patent Number: 4,948,051

[45] Date of Patent: Aug. 14, 1990

[54] ROTARY ELEMENT FOR LIQUID DISTRIBUTION

[75] Inventor: David C. Gill, Bristol, Great Britain

[73] Assignee: Nomix Mfg. Co. Ltd., Bristol, England

[21] Appl. No.: 344,430

[22] Filed: Apr. 26, 1989

Related U.S. Application Data

[63] Continuation of Ser. No. 59,104, Jun. 8, 1987, abandoned.

[30] Foreign Application Priority Data

Jun. 12, 1986 [GB] United Kingdom ..... 8614355

[51] Int. Cl.[5] ..... B05B 3/10

[52] U.S. Cl. ..... 239/223; 239/498

[58] Field of Search ..... 239/222.11, 223, 224, 239/498, 502

[56] References Cited

U.S. PATENT DOCUMENTS

| | | | |
|---|---|---|---|
| 442,865 | 12/1890 | Kinder . | |
| 2,220,275 | 11/1940 | Preston | 239/223 |
| 2,888,206 | 5/1959 | Waldrum . | |
| 3,073,531 | 1/1963 | Kothe . | |
| 3,085,749 | 4/1963 | Schweitzer . | |
| 3,346,192 | 10/1967 | Hege | 234/223 |
| 3,455,507 | 7/1969 | Ryder et al. . | |
| 3,459,586 | 8/1969 | Kiwiet | 117/96 |
| 4,094,468 | 6/1978 | Volle | 239/294 |
| 4,225,084 | 9/1980 | Bals | 234/223 |
| 4,294,408 | 10/1981 | Snyder et al. | 239/214 |
| 4,360,155 | 11/1982 | Hubbell et al. | 239/3 |
| 4,407,217 | 10/1983 | Jackson | 118/24 |
| 4,609,148 | 2/1986 | Gill | 239/224 |
| 4,690,326 | 9/1987 | Gill | 239/223 |
| 4,712,738 | 12/1987 | Gill | 239/74 |
| 4,772,152 | 9/1988 | Gill | 403/289 |
| 4,790,483 | 12/1988 | Gill | 239/224 |

FOREIGN PATENT DOCUMENTS

| | | |
|---|---|---|
| 470835 | 2/1968 | Australia . |
| 41008 | 12/1981 | European Pat. Off. . |
| 110713A1 | 6/1984 | European Pat. Off. . |
| 110713B1 | 1/1988 | European Pat. Off. . |
| 2559144 | 6/1977 | Fed. Rep. of Germany . |
| 2351709 | 12/1977 | France . |
| 2362673 | 3/1978 | France . |
| 345714 | 10/1930 | United Kingdom . |
| 862742 | 3/1961 | United Kingdom . |
| 991973 | 5/1961 | United Kingdom . |
| 901969 | 7/1962 | United Kingdom . |
| 1046065 | 10/1965 | United Kingdom . |
| 1173272 | 12/1969 | United Kingdom . |
| 1340097 | 12/1973 | United Kingdom . |
| 1343337 | 1/1974 | United Kingdom . |
| 1460132 | 12/1976 | United Kingdom . |
| 1515511 | 6/1978 | United Kingdom . |
| 2008439 | 6/1979 | United Kingdom . |
| 2026904 | 2/1980 | United Kingdom . |
| 2043489B | 10/1980 | United Kingdom . |
| 2043489A | 10/1980 | United Kingdom . |
| 2043489 | 10/1980 | United Kingdom . |
| 2123714 | 2/1984 | United Kingdom . |
| 2131327 | 6/1984 | United Kingdom . |
| 2136321 | 9/1984 | United Kingdom . |
| 2144347 | 3/1985 | United Kingdom . |
| 2155816 | 10/1985 | United Kingdom . |

OTHER PUBLICATIONS

"An Evaluation of Fourteen Hand-Held Battery-Operated Spinning Disc Sprayers", Arnold, Tropical Pest Management 29(2) pp. 105-121.

"Spinning Disc Sprayer for Low Volume Herbicide Application"; Tecnoma.

*Primary Examiner*—Andres Kashnikow

*Assistant Examiner*—Kevin P. Weldon

*Attorney, Agent, or Firm*—Merchant, Gould, Smith, Edell, Welter & Schmidt

[57] ABSTRACT

A rotary element (8), for distributing liquids such as herbicide, comprises a concave liquid receiving surface (22) including a conical outer portion (26). Teeth (28) project from the outer portion (26). Each tooth has an upper surface (30) which is inclined to the rotary axis of the element by a greater angle than is the outer portion (26). Each tooth has side surfaces (32) which extend parallel to the rotary axis and have a maximum axial dimension (t) which is greater than 0.01, and preferably 0.05, times the overall diameter of the element.

12 Claims, 3 Drawing Sheets

ROTARY ELEMENT FOR LIQUID DISTRIBUTION

This is a continuation, of application Ser. No. 059,104, filed 8 June 1987 now abandoned.

This invention relates to a rotary element for distributing liquids, such as herbicides, under centrifugal force.

If liquids are to be distributed from a rotary element so as to form evenly distributed droplets of consistent size, the design of the rotary element is critical. This is particularly so if the rotary element is intended for satisfactory operation at different rotary speeds, for example in order to vary the spray width.

Many herbicides in current use are relatively viscous (compared, for example, to water), and this adds to the difficulties. Experience with these liquids has shown that it is very difficult to eliminate "fines", that is droplets which are considerably smaller than the desired droplet size. These fines are discharged from the disc along with droplets of the desired size, and, because of their small size, are decelerated rapidly after leaving the disc. Also, they are subject to wind drift. These two factors make it impossible to achieve the desired spray pattern.

According to the present invention there is provided a rotary element for rotation about a rotary axis to distribute a liquid, the element having a central region comprising a concave liquid receiving surface, and an outer region comprising a plurality of projections extending outwardly from the central region, each projection comprising an upper surface which adjoins the liquid receiving surface and is inclined to a plane perpendicular to the rotary axis at a smaller angle than the adjacent part of the liquid receiving surface, each projection also comprising two side surfaces which extend substantially parallel to the rotary axis.

The upper surface of each projection may extend substantially perpendicular to the rotary axis. In a preferred embodiment, they are inclined at an angle of 5° to a plane perpendicular to the rotary axis. In a preferred form, the projections comprise pointed teeth, the upper surface of each projection being generally triangular, with the base defined by the junction between the upper surface and the liquid receiving surface, and the apex constituted by the outermost extremity of the projection. The side surfaces of each projection thus meet each other at the outermost extremity of the projection. Alternatively, the upper surface of each projection may be generally trapezoidal, the outermost extremity of each projection being constituted by an edge extending circumferentially of the rotary axis.

At least part of the liquid receiving surface may be substantially conical, preferably having a vertex angle which is not less than 20° and not more than 160°. In one embodiment in accordance with the present invention, the portion of the liquid receiving surface adjacent the order region has a vertex angle of 90°. The liquid receiving surface in this embodiment is thus inclined by 45° to a plane perpendicular to the rotary axis.

The side surfaces of each projection may be planar, but alternatively they could be curved or made up of two or more planar surfaces which are inclined to each other. An embodiment of a rotary element in accordance with the present invention may have a diameter of 30 to 50 mm. The element may have, for example, between thirty and forty projections, although elements having as few as three or four projections (in which case the element would appear generally triangular or square) may provide satisfactory results. The side surfaces, at their widest position, may have an axial dimension which is greater than 0.01 times, and preferably greater than 0.05 times, the diameter of the element. For example, in an element with a diameter of 40 mm, the widest axial dimension of the teeth may be 3 mm. The length of each projection, from the junction between its upper surface and the liquid receiving surface to its outermost extremity, may be 0.05 to 0.2 times the diameter of the disc and may, for example, be approximately 4 mm in a disc having a diameter of 40 mm.

For a better understanding of the present invention, and to show how it may be carried into effect, reference will now be made, by way of example, to the accompanying drawings, in which.

Figure 2:
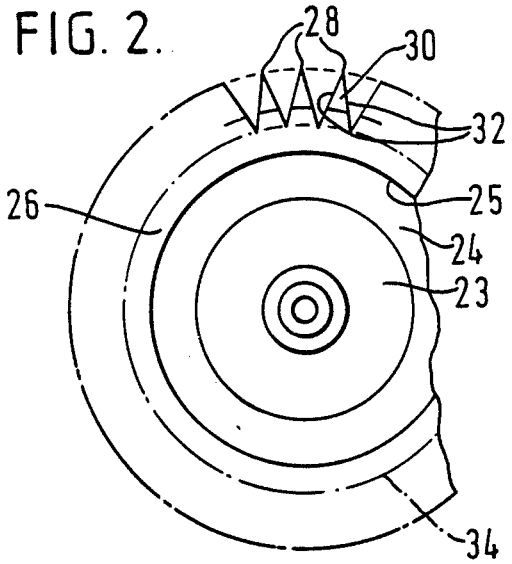
FIG. 2 is a view of the rotary element in the direction II in FIG. 1.
Figure 4:
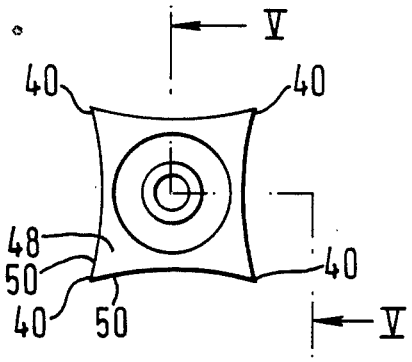
Figure 5:
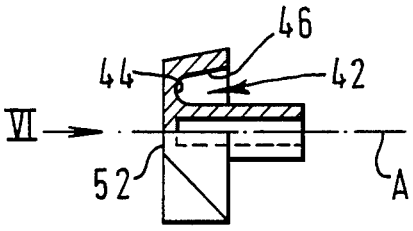
Figure 6:
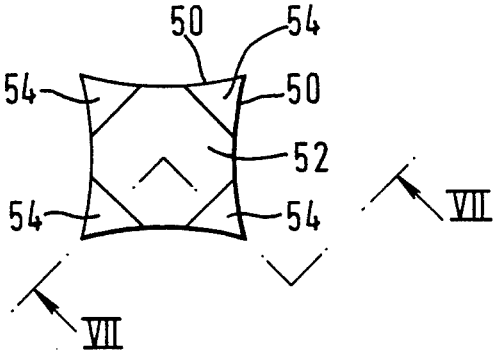

FIG. 4 corresponds to FIG. 2, but shows an alternative rotary element;

FIG. 5 is a partly sectioned side view of the rotary element of FIG. 4, taken on the line V—V in FIG. 4;

FIG. 6 is a view in the direction of the arrow VI in FIG. 5; and

Figure 7:
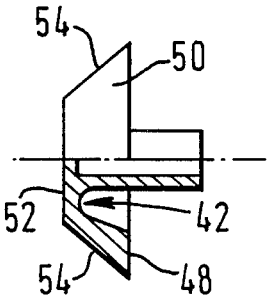

FIG. 7 is a partly sectioned view on the line VII—VII in FIG. 6.

Figure 1:
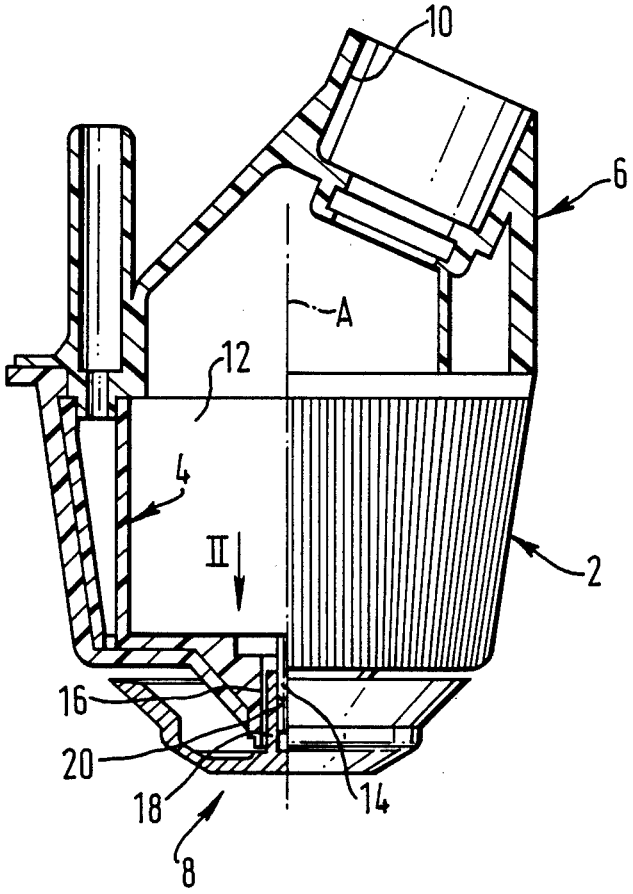
FIG. 1 is a partly sectioned view of a spraying head having a rotary element.

The spraying head shown in FIG. 1 comprises outer and inner elements 2 and 4 which are rotatable relatively to each other to adjust the flow rate of liquid (such as herbicide) to the rotary element 8. The elements 2 and 4 are secured to a fitting 6 having a recess 10. In use of the equipment, the recess 10 receives one end on elongate support member which is carried at the other end by an operator so that the spraying head is disposed close to the ground. The spraying head is disclosed in more detail in my co-pending Pat. Application No. 8523647.

The inner element 4 defines a cavity in which an electric motor 12 is accommodated. The motor 12 has an output shaft 14 which projects into a cylindrical bore 16 formed in the inner element 4. The rotary element 8 has a shank 18 having a bore 20. The shank 18 enters the bore 16, and the bore 20 fits relatively tightly over the shaft 14 so that the element 8 is rotated when the motor 12 is energised.

In use, the spraying head is carried with the rotary element 8 lowermost, as shown in FIG. 1. Liquid to be sprayed is conveyed between the inner and outer elements 4 and 2 to emerge from the annular gap 20 between these elements. The liquid flows onto the rotary element 8 to be discharged from the periphery of the element 8 under centrifugal force.

Figure 3:
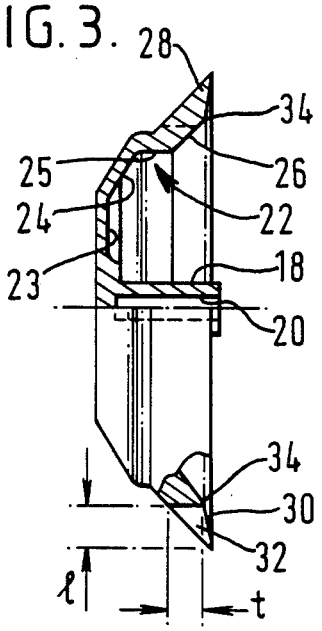
FIG. 3 is a partly sectioned side view of the rotary element of FIG. 2.

The rotary element 8 is shown in greater detail in FIGS. 2 and 3. The element has a liquid receiving surface 22 which has a central portion 23, which is perpendicular to the rotary axis A of the element 8, an inner portion 24 and an outer portion 26. The inner portion 24 and the outer portion 26 are connected to each other by a cylindrical intermediate portion 25. The inner portion 24 is generally conical, having a vertex angle of approximately 120°. The other portion 26 is also substantially conical but has a smaller vertex angle of approximately 90°. A plurality of projections in the form of teeth 28 extend from the outer portion 26 of the liquid receiving surface 22.

Each tooth has an upper surface 30 and two side surfaces 32. The upper surface 30 is inclined at an angle of 5° to a plane which is substantially perpendicular to the rotary axis A of the element 8, and meets the outer portion 26 of the liquid receiving surface 22 on a line 34. It will be appreciated that the angle between the outer portion 26 of the liquid receiving surface and the upper surface 30 of each tooth 28 is approximately 220°.

As shown in FIG. 3, the side surfaces 32 each taper in the radially outward direction to a point at the extremity of the respective tooth 28. At their widest point, of the side surfaces 32 have an axial dimension t of approximately 3 mm, the overall diameter of the element 8 being approximately 40 mm. The length of each tooth 28 from the line 34 to the extremity of the tooth is approximately 4 mm.

In operation, liquid emerging from the gap 20 initially flows to the central portion 23 of the liquid receiving surface 22. Rotation of the element 8 causes the liquid to spread outwardly over the liquid receiving surface 22 as a thin film. When the liquid reaches the teeth 28, some of the liquid will flow over the upper surface 30 of the teeth 28, and some will flow onto the relatively wide side surface 32. In each case, the liquid continues to flow outwardly, and all of the liquid is discharged as droplets of uniform size from the points of the teeth 28. Because the upper surface of the teeth 28 extend almost perpendicular to the rotary axis A, the tendency is minimised for the liquid to the discharged from the teeth 28 at positions radially inwardly from their outer extremities. Consequently, controlled discharge of the liquid takes place enabling a reliable even distribution of droplets to be achieved over a wide range of rotary speeds, without the formation of any significant quantity of fines. It is believed that the relatively large axial extent of the side surfaces 32 also contributes to this effect.

An alternative embodiment is shown in FIGS. 4 to 7. This disc has four "teeth" 40, and, as a consequence, is approximately square, although the sides of the square are somewhat arcuately. As with the disc of FIGS. 1 to 3, the disc of FIGS. 4 to 7 has a liquid receiving surface 42 having a central region 44 and a conical outer region 46. The central region 42 is shown in FIG. 5 as being concavely curved, but alternatively it could be flat, like central region 23 of the disc shown in FIG. 3. outer region 46 has a vertex angle of 20°.

Each tooth 40 has an upper surface 48 and side surface 50. The upper surface 48 is perpendicular to the axis A of the disc. The side surfaces 50 lie in planes which are parallel to the axis A. The dimension t of each side surface 50 at its widest point is approximately 4.5 mm, the overall dimension of the disc, along a diameter, being approximately 16 mm.

It will be appreciated from FIGS. 4 to 7 that the lower face 52 of the disc is perpendicular to the axis A. Four oblique faces 54, inclined at 40° to the axis A, extend from the face 52 to the points of the teeth 40.

The disc of FIGS. 4 to 7 operates in substantially the same way as that FIGS. 1 to 3, but is suitable when a narrower spraying width is required.

I claim:

1. A rotary element for rotation about a rotary axis to distribute a liquid, the element comprising:

a liquid receiving surface having a central recess for receiving a liquid, the recess having an outer peripheral wall, a planar surface extending from the peripheral wall and lying substantially perpendicular to the rotary axis, the planar surface having an outer periphery, a plurality of side surfaces extending from the outer periphery of the planar surface and lying substantially parallel to the rotary axis, a flat end face which extends perpendicular to the rotary axis and adjoins the side surfaces, and a plurality of oblique corner faces which extend from the end face to the planar surface and which lie oblique to the rotary axis, respective ones of the corner faces, respective adjacent side surfaces and the planar surface substantially meeting each other at a respective corner of the planar surface.

2. A rotary element as claimed in claim 1, in which the side surfaces are concave, as viewed along the rotary axis.

3. A rotary element according to claim 1, in which the outer periphery is defined by four side surfaces.

4. A rotary element according to claim 1, wherein said outer wall of the recess is generally smooth.

5. A rotary element according to claim 1 in which the side surfaces, at their radially innermost position, have an axial dimension which is not less than 0.05 times the overall diameter of the element.

6. A rotary element as claimed in claim 1, in which the side surfaces, at their radially innermost position, have an axial dimension which is not less than 0.25 times the overall diameter of the element.

7. A rotary element according to claim 2 wherein said concave side walls are arcuate.

8. A rotary element for rotation about a rotary axis to distribute a liquid, the element comprising:

a liquid receiving surface having a central recess for receiving a liquid, said recess having an outer conical wall extending obliquely of the rotary axis and defining a circumferential edge line, a plurality of adjacent teeth each extending generally radially outwardly at the periphery of the rotary element, each tooth comprising a generally triangular surface which lies in a plane extending substantially perpendicular to the rotary axis, the triangular surface being defined by a base edge, coincident with said circumferential edge line, and two side edges which extend from opposite ends of the base line and meet each other at the tip of the tooth, each tooth further comprising side walls extending from the side edges, the side walls lying in planes extending parallel to the rotary axis and adjoining a lower surface of the tooth, which lower surface is oblique to the rotary axis, so that liquid distributed by the rotary element will travel along the conical wall and be split into independent streams as the liquid travels onto the triangular surfaces of the teeth, to be discharged from the tips of the teeth.

9. An element according to claim 8 wherein said conical wall is generally smooth.

10. A rotary element according to claim 8 in which said side walls, at their radially innermost position, have an axial dimension which is not less than 0.05 times the overall diameter of the element.

11. A rotary element as claimed in claim 8 in which said side walls, at their radially innermost position, have an axial dimension which is not less than 0.25 times the overall diameter of the element.

12. A rotary element according to claim 8 in which the lower surface of each tooth meets the respective triangular surface at the tip of the tooth.

* * * * *

UNITED STATES PATENT AND TRADEMARK OFFICE

CERTIFICATE OF CORRECTION

PATENT NO. : 4,948,051

DATED : August 14, 1990

INVENTOR(S) : David C. Gill

It is certified that error appears in the above-identified patent and that said Letters Patent is hereby corrected as shown below:

Column 3, line 13, delete "of" (2nd).

Column 3, line 42, after "arcuately" insert --concave--.

Column 3, line 47, after "FIG. 3." insert "The".

Column 3, line 61, after "that" insert --of--.

Signed and Sealed this

Thirty-first Day of March, 1992

*Attest:*

HARRY F. MANBECK, JR.

*Attesting Officer*

*Commissioner of Patents and Trademarks*